United States Patent [19]

Creed et al.

[11] 4,399,761

[45] Aug. 23, 1983

[54] RESILIENT BOBBIN THREAD PULL-OFF MEMBER FOR LOCKSTITCH SEWING MACHINE

[75] Inventors: Gerald J. Creed, Rahway; Thaddeus J. Zylbert, Morris Plains, both of N.J.

[73] Assignee: The Singer Company, Stamford, Conn.

[21] Appl. No.: 282,306

[22] Filed: Jul. 13, 1981

[51] Int. Cl.[3] ..... D05B 49/00; D05B 27/02

[52] U.S. Cl. ..... 112/242; 112/323

[58] Field of Search ..... 112/184, 191, 242, 243, 112/246, 323

[56] References Cited

U.S. PATENT DOCUMENTS

| | | | |
|---|---|---|---|
| 715,911 | 12/1902 | Warren | 112/58 |
| 1,105,968 | 8/1914 | Diehl et al. | 112/242 |
| 1,792,237 | 2/1931 | Parkes | 112/184 |
| 2,884,882 | 5/1959 | Donaldson, Jr. | 112/242 X |
| 3,164,113 | 1/1965 | Ketterer | 112/242 |
| 4,091,753 | 1/1978 | Johnson et al. | 112/184 |
| 4,182,250 | 1/1980 | Johnson | 112/184 |
| 4,215,639 | 8/1980 | Johnson | 112/242 |
| 4,326,474 | 4/1982 | Zylbert | 112/184 |

FOREIGN PATENT DOCUMENTS

| | | | |
|---|---|---|---|
| 382424 | 10/1931 | United Kingdom | 112/184 |

OTHER PUBLICATIONS

U.S. Patent Application Serial No. 06/204,426 to Johnson.

*Primary Examiner*—Wm. Carter Reynolds
*Attorney, Agent, or Firm*—William V. Ebs; Robert E. Smith; Edward L. Bell

[57] ABSTRACT

A lockstitch sewing machine is provided with an elongate resilient member which is affixed at one end in the machine and extends under the feed dog of the machine for engagement thereby. The resilient member is flexed by the feed dog during downward movement thereof and then acts against bobbin thread pulling it from the bobbin spool. The elongate member relaxes and separates from the bobbin thread during upward movement of the feed dog.

6 Claims, 7 Drawing Figures

RESILIENT BOBBIN THREAD PULL-OFF MEMBER FOR LOCKSTITCH SEWING MACHINE

DESCRIPTION

FORM OF THE INVENTION

The invention relates to thread handling devices for use in sewing machines, and more particularly to mechanism for pulling thread from the bobbin spool of a lockstitch sewing machine.

DESCRIPTION OF THE PRIOR ART

It is known to provide a lockstitch sewing machine with means for pulling thread from a bobbin spool for use in the formation of stitches. More particularly, it is known to provide mechanism actuable by a feed dog for pulling thread from a bobbin in a lockstitch sewing machine. Such mechanism may be seen, for example, in U.S. Pat. No. 4,182,258 of The Singer Company for "Bobbin Thread Control Means for a Lock Stitch Sewing Machine" issued Jan. 8, 1980. However, the mechanisms which have been provided heretofore for pulling thread from a bobbin have been lacking in simplicity, and as a consequence have been expensive items to provide in a machine. Also, insofar as such mechanisms rely upon thread tension during stitch setting to move a thread pull-off member in other than a thread pulling direction as disclosed, for example, in the said patent, they cause undesireable forces to be imparted to various thread handling components of a machine, and cause stitches to pucker.

It is a prime object of the present invention to provide an improved, simply constructed, inexpensive bobbin thread pull-off arrangement for use in a lockstitch sewing machine.

It is another object of the invention to provide a lockstitch sewing machine with an improved bobbin thread pull-off arrangement which avoids the necessity of having to rely upon thread tensioning for the repositioning of a thread pull-off member during stitch setting.

Other objects and advantages of the invention will become apparent during a reading of the specification taken in connection with the accompanying drawings.

SUMMARY OF THE INVENTION

In accordance with the invention, a lockstitch sewing machine is provided with an elongate resilient member which is fixed at one end only and which is disposed to extend under a feed dog for engagement and flexure thereby during downward movement of the feed dog. Fixed walls are provided between a bobbin spool and needle, and when the elongate member is flexed a portion moves downwardly between such fixed walls to pull bobbin thread, directed under the member and over the walls, into the space between the walls for subsequent use during stitch formation. During upward movement of the feed dog the elongate member relaxes and moves away from the bobbin thread. Preferrably, the fixed walls are provided on a bobbin case having the bobbin spool rotatably supported therein, the secured end of the elongate resilient member is affixed to a bobbin case restraining member, and the opposite end of the resilient member is guided in a slot in the restraining member.

DESCRIPTION OF THE PREFERRED EMBODIMENT OF THE INVENTION

Figure 1:
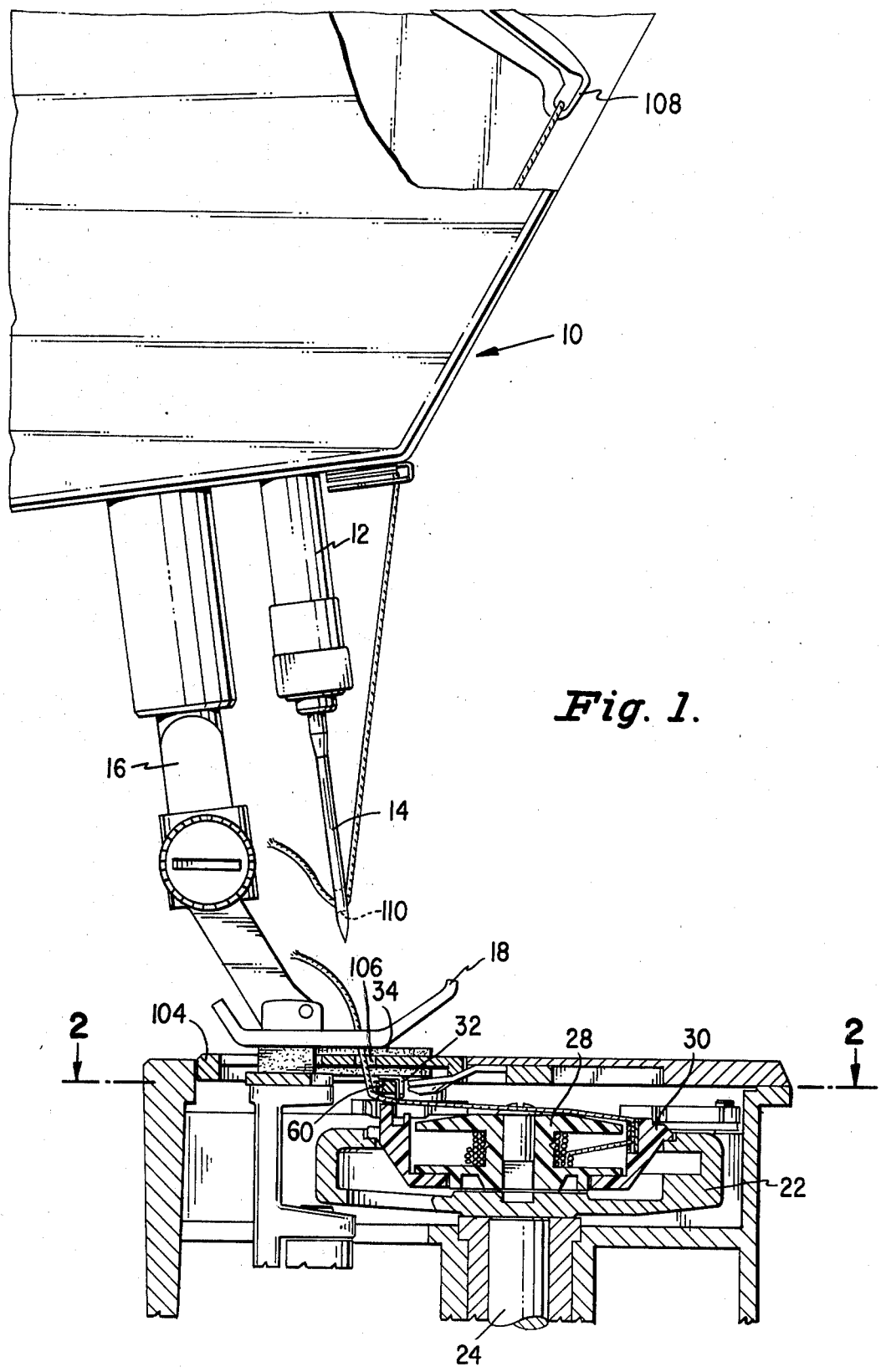
FIG. 1 is a fragmentary end elevational view partially in section of a sewing machine including a bobbin thread pull-off arrangement in accordance with the invention.
Figure 2:
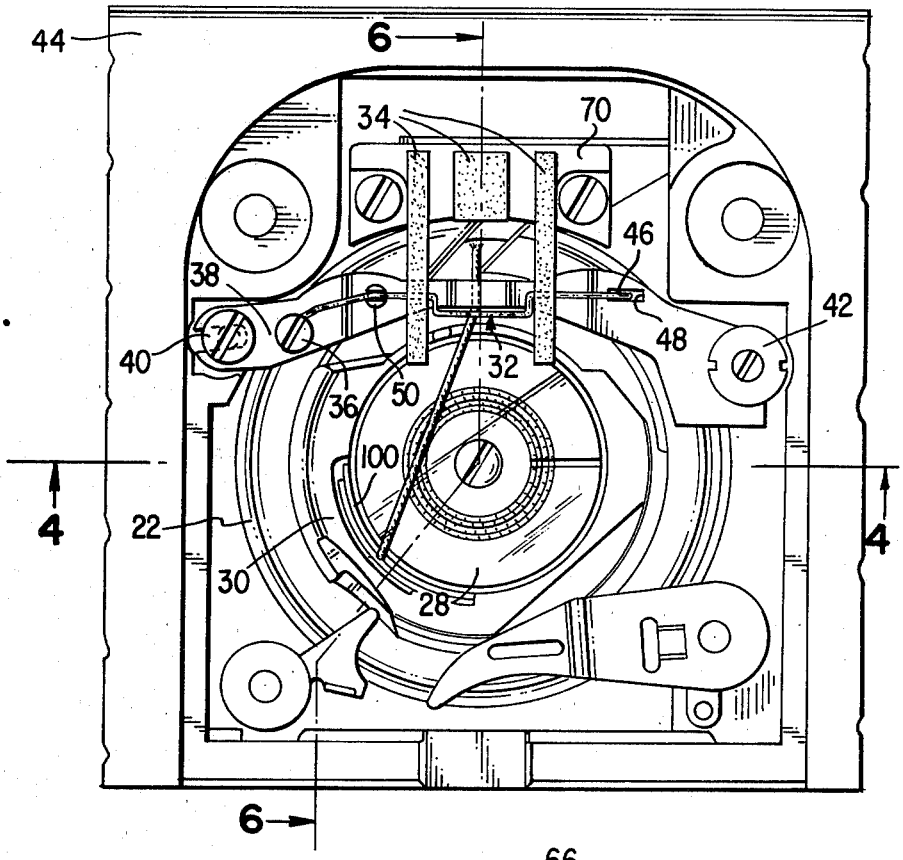
FIG. 2 is a top plan view taken substantially on the plane of the line 2—2 of FIG. 1.

Referring to the drawings, reference character 10 designates the head end of a lockstitch sewing machine wherein a needle bar 12 is vertically reciprocable. A sewing needle 14 is affixed to the needle bar 12 for reciprocation thereby. As shown, the head end 10 of the sewing machine carries a presser bar 16, and the presser bar carries a foot 18 which is used to hold down work at it is sewn with the needle 14.

Thread 20 is supplied to the needle 14 for use in forming stitches, and a looptaker 22 which is rotatable by a shaft 24 cooperates in a known manner with the needle to cause lockstitches to be formed in material 25 with the needle thread 20 and thread 26 supplied from a bobbin spool 28 rotatably mounted in a stationary bobbin case 30. A detailed description of the manner in which such a looptaker cooperates with a needle to form lockstitches may be found, for example, in U.S. Pat. No. 2,862,468 of R. E. Johnson for "Ornamental Stitch Sewing Machines" issued Dec. 2, 1958 and assigned to The Singer Company.

The machine is provided, in accordance with the invention, with a resilient bobbin thread pull-off member 32 which extends under and is actuable by a feed dog 34. As shown, the bobbin thread pull-off member 32 is affixed at one end by a screw 36 to a member 38 which is fastened at 40 and 42 to the bed 44 of the machine. The opposite end 46 of member 32 extends through and is guided in a through slot 48 in the member 38. Member 32 is also guided in a slotted post 50 which is affixed to member 38.

The bobbin case 30 is formed with spaced upstanding walls 54 and 56 which define a thread receiving trough 58 therebetween. Member 38 includes a bridge portion 60 which brackets wall 54 and thereby restrains rotation of the bobbin case. As shown, elongate resilient member 32 includes a portion 62 over member 38 between bridge 60 and screw 36, and includes a portion 64 over member 38 between bridge 60 and slot 48. Elongate member 38 also includes a portion 66 which extends around the ends of bridge 60 and into alignment with thread receiving trough 58.

Figure 3:
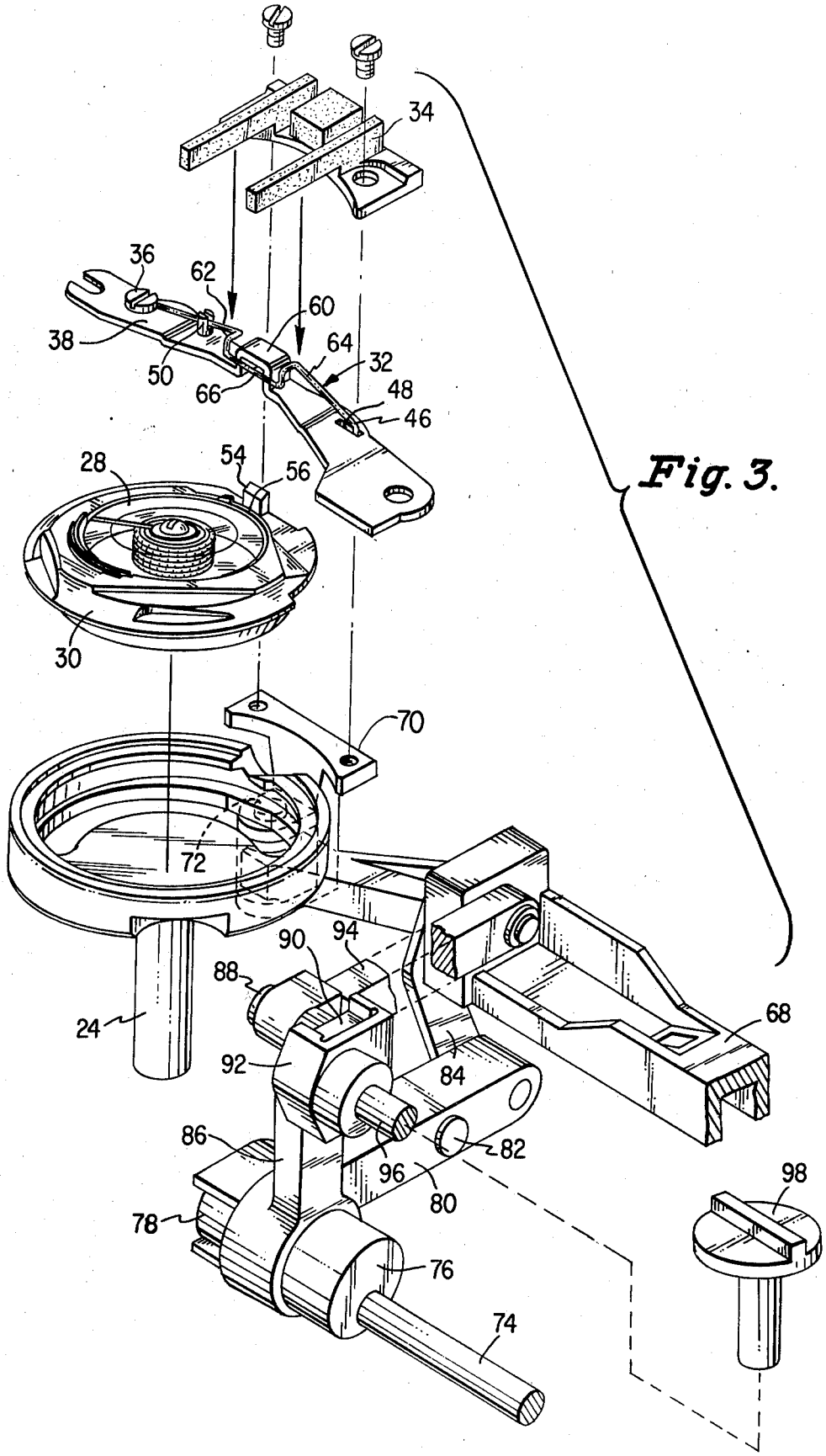
FIG. 3 is an exploded perspective view illustrating the construction of the bobbin thread pull-off arrangement of the invention.

The feed dog 34 advances material under needle 14 and moves as usual along a more or less elliptical path having vertical components. Work feeding movements of the feed dog are determined by a control system which may, for example, be of the type shown and described, for example, in U.S. Pat. No. 3,527,183 for "Work Feeding Mechanism for Sewing Machines" of The Singer Company, issued Sept. 8, 1972. FIG. 3 shows such a work feed control system including a feed bar 68 mounted in the machine so that it may be oscillated in mutually perpendicular directions to impart substantially vertical and horizontal motion to the feed dog 34. The feed dog is carried by a bracket 70 which is secured to a pivot pin 72 journalled in the feed bar. A bed shaft 74, journalled in the machine frame and driven in synchronism with the needle actuating mechanism of the machine rotates an eccentric 76 and a lift cam 78. The lift cam imparts vertical motion to the feed bar through a bifurcated lever 80 pivoted on a fixed stud shaft 82, and through a link 84. Transverse feed motion is imparted to the feed bar by means of the eccentric 76, pitman 86, pivot pin 88, slide block 90, feed regulator block 92 and link 94. A vertical position of the feed regulator block 92 results in zero feed, whereas a clockwise position relative thereto as viewed in FIG. 3 results in the forward feeding of material and a stitch length which is in proportion to the clockwise displacement of the block 92 from the vertical. A counterclockwise position of the regulator block relative to the vertical results in the reverse feeding of material and a stitch length which is in proportion to the counterclockwise displacement of block 92 from the vertical. Regulator block 92 is positionable by shaft 96 which in turn may be positionable as by a manually operable stitch length selector 98.

Bobbin thread 26 extends from bobbin spool 28 through a bobbin case thread tensioning device 100. The thread exiting from the device extends over the top of the bobbin, and over the bobbin case walls 54 and 56, but under portion 66 of the elongate thread pull-off member 32, after which the thread passes up through an opening 106 in throat plate 104. Needle thread 20, from a supply spool, after passing through a conventional thread tensioning device (not shown) and a take-up arm 108 extends through the eye 110 of needle 14.

The needle 14, looptaker 22, and feed dog 34 operate in timed relationship during sewing operations and lockstitches are formed in the material being sewed, all in a manner such as described in U.S. Pat. No. 2,862,468 (mentioned hereinbefore) except that bobbin thread is supplied for stitches in accordance with the invention by the operation of elongate resilient member 32.

Figure 4:
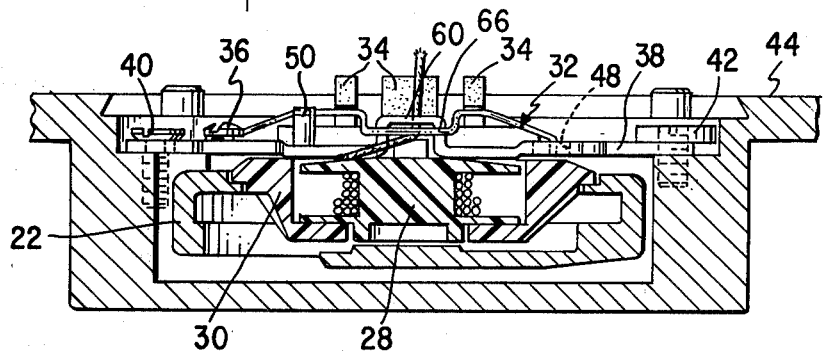
FIG. 4 is a sectional view taken on the plane of the line 4—4 of FIG. 2 and showing a thread pull-off member according to the invention in a relaxed condition.
Figure 5:
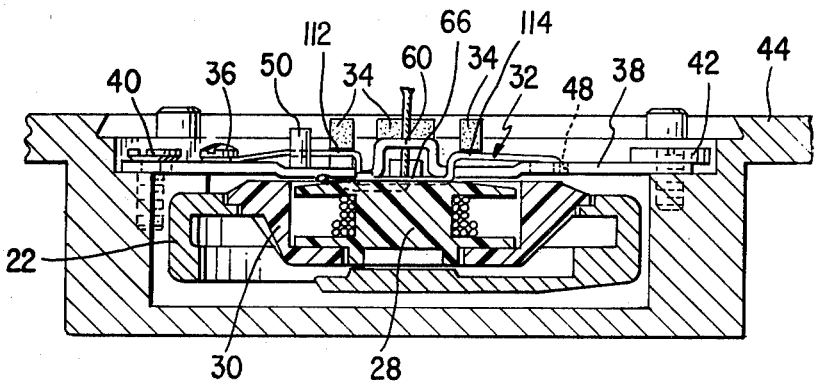
FIG. 5 is a view similar to FIG. 4 showing the pull-off member in a flexed condition.
Figure 6:
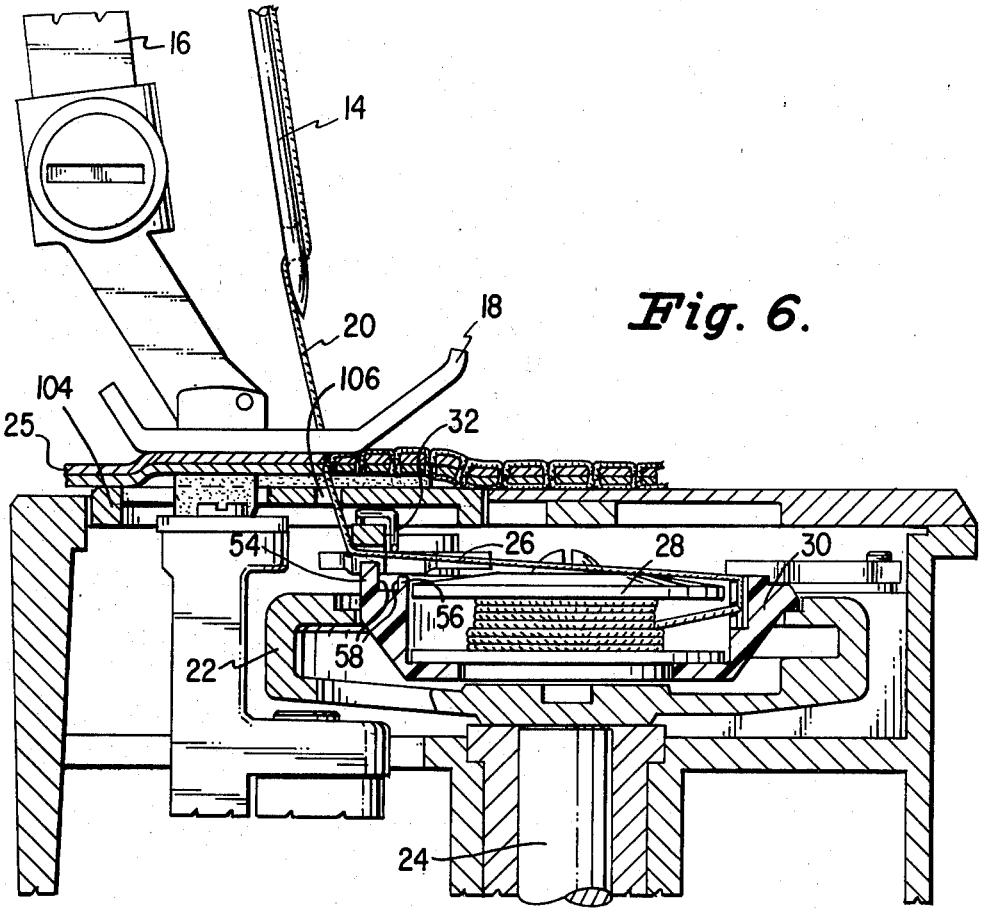
FIG. 6 is a view taken on the plane of the line 6—6 of FIG. 2 and showing the thread pull-off member in a relaxed condition.
Figure 7:
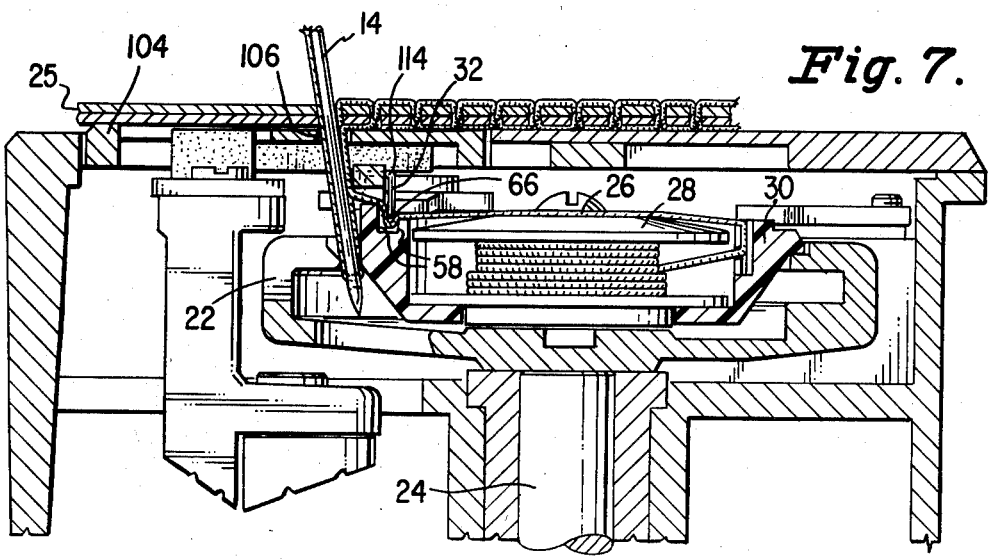
FIG. 7 is a view similar to FIG. 6 showing the pull-off member flexed.

When the feed dog completes a work feeding movement in either forward or reverse feed, the bobbin thread 26 is taut and tightly spans the space between bobbin case walls 54 and 56 (see FIGS. 4 and 6). Resilient member 32 is then relaxed. However, when the feed dog moves downwardly beyond the work feed position, it acts downwardly upon member 32 at 112 and 114 on opposite sides of bridge 60 of member 38, and the member is flexed. Portion 66 of the member 32 moves into engagement with the bobbin thread and down into the trough 58 between bobbin case walls 54 and 56 with the engaged thread causing thread to be pulled from the bobbin (see FIGS. 5 and 7) for subsequent use during the formation of a stitch.

Beyond its lowest position, the feed dog 34 moves in a direction opposite to the work feeding direction and then upwardly after which it resumes movement in a work feeding direction. As the feed dog moves upwardly the thread pull-off member 32 relaxes and portion 66 thereof moves upwardly away from the bobbin thread temporarily leaving slack thread in trough 58. During movement of the feed dog in a work feeding direction, a stitch is set in the usual manner by operation of needle thread take-up, arm 108, and the slack thread is drawn from trough 58 by the pull of a loop of needle thread on the bobbin thread. The thread is pulled taut across the space between bobbin case walls 54 and 56 and is thereby once again readied for engagement by the elongate thread pulling member 32 as such member is moved downwardly by feed dog 34.

It is to be understood that the present disclosure relates to a preferred embodiment of the invention which is for purposes of illustration only, and that various modifications may be made therein without departing from the spirit and scope of the invention as defined in the appended claims.

We claim:

1. In a lockstitch sewing machine, mechanism for removing lengths of thread from a bobbin for use in the formation of stitches in material moved under a needle by a feed dog having vertical components of movements perpendicular to the work feeding direction, said mechanism including: fixed spaced walls between the bobbin spool and needle; and an elongate resilient member having one end fixed, said member being disposed to extend under the feed dog for engagement by the feed dog during downward movement thereof resulting in the flexure of the member and at least a portion of the member moving downwardly in the space between the fixed walls to pull thread, directed under the said member and over the walls, from the bobbin spool and into the space between the walls, said member being movable away from the thread upon relaxation thereof during upward movement of the feed dog, the spaced walls being located on a bobbin case which rotatably supports the bobbin and which is restrained against movement in a looptaker by a fixed member having the said one end of the elongate resilient member secured thereon, the other end of the resilient member being guided in a through opening in the fixed member.

2. The combination of claim 1 wherein said opening is a through slot.

3. The combination of claim 1 including additional guide means on the bobbin case restraining member for the elongate member.

4. In a lockstitch sewing machine, mechanism for removing lengths of thread from a bobbin for use in the formation of stitches in material moved under a needle by a feed dog having vertical components of movements perpendicular to the work feeding direction, said mechanism including: fixed spaced walls between the bobbin spool and needle; and an elongated resilient member having one end fixed, said member being disposed to extend under the feed dog for engagement by the feed dog during downward movement thereof resulting in flexure of the member and at least a portion of the member moving downwardly in the space between the fixed walls to pull thread, directed under the said member and over the walls, from the bobbin spool and into the space between the walls, said member being movable away from the thread upon relaxation thereof during upward movement of the feed dog, the spaced walls being located on a bobbin case which rotatably supports the bobbin and which is restrained against movement in a looptaker by a fixed member having the said one end of the elongate resilient member secured thereon, the fixed member including a bridging portion which brackets one of the bobbin case walls, and the elongate resilient member being engageable by the feed dog on opposite sides of said bridging portion during downward movement of the feed dog.

5. The combination of claim 4 wherein the elongate member is formed to extend around the bridging portion of the bobbin case restraining member.

6. The combination of claim 4 wherein the elongate member extends over the bobbin case restraining member on each of opposite sides of the bridging portion of the bobbin case restraining member.

* * * * *